US007950552B2

(12) United States Patent
Fan

(10) Patent No.: US 7,950,552 B2
(45) Date of Patent: May 31, 2011

(54) GUN COVER WITH SECURING ASSEMBLY

(76) Inventor: Chi-Yun Fan, Taipei (TW)

( * ) Notice: Subject to any disclaimer, the term of this patent is extended or adjusted under 35 U.S.C. 154(b) by 1206 days.

(21) Appl. No.: 11/546,231

(22) Filed: Oct. 12, 2006

(65) Prior Publication Data

US 2008/0142556 A1 Jun. 19, 2008

(51) Int. Cl.
*F41C 33/02* (2006.01)

(52) U.S. Cl. ..... 224/243; 224/244

(58) Field of Classification Search ..... 224/192, 224/193, 238, 243, 244, 911, 912
See application file for complete search history.

(56) References Cited

U.S. PATENT DOCUMENTS 6,769,582 B1 * 8/2004 Beletsky et al. ..... 224/244
2006/0226185 A1 * 10/2006 Har-Shen ..... 224/244
* cited by examiner

*Primary Examiner* — Justin M Larson

(57) ABSTRACT

A gun cover with a securing assembly includes a waist plate at an inner side thereof; and an enclosure for defining a gun groove; the enclosure having an inner lateral plate and an outer lateral plate; the inner lateral plate having a through hole for receiving an elastic tenon which protrudes from an interior of the gun groove; the elastic tenon having a press portion; and the press portion being installed between the inner lateral plate and an inner side of the waist plate and projecting out of an upper side of the outer frame.

1 Claim, 6 Drawing Sheets

GUN COVER WITH SECURING ASSEMBLY

FIELD OF THE INVENTION

The present invention relates to guns, and particularly to a gun cover with a securing assembly, in that a pistol can be received and secured firmly therein.

BACKGROUND OF THE INVENTION

Generally, a police pistol is received in a gun cover and then the gun cover is secured to a waist plate strip or a back strip or a shoulder strip for hanging the gun cover. However, in most condition, the gun cover is placed at a right side of the waist (or a left side of the waist). However, the gun cover is designed to be received the pistol easily and thus the pistol easily falls out.

Therefore, there are some designs which can steadily secure the pistol in the gun cover. Referring to FIG. 1, the gun cover 1 has a waist plate 10 and an enclosure 11 which defines a gun groove 12. The enclosure 11 further has an inner lateral plate 111 and an outer lateral plate 112. The inner lateral plate 111 has a through hole for receiving an elastic tenon which is protruded from an interior of the gun groove 12. A top of the elastic tenon 113 has a cambered surface so that the pistol can be received therein from an upper side smoothly. However, in this design, the pistol is confined in a pull-out operation so that it is difficult to pull the pistol out of the cover. The pistol must be inclined for being pulled out.

In another improvement design, a gun cover has a gun groove. The gun groove has two opposite lateral plates. At least one lateral plate is formed with a recess at a position corresponding to a protection unit of a trigger of the gun. A tenon plate is installed at an upper position of the recess which is elastic. The tenon plate has a projection unit facing an interior of the recess so that when the gun is received in the gun groove, the protrusion is secured in the protection unit. Another end of the tenon plate is protruded with a press portion. When a force is applied to the press portion, the protrusion of the tenon plate separates from the recess.

The press portion is installed at an outer side of the gun cover and thus it is easily pressed so that the gun will fall out. Furthermore the press portion is installed at the lateral side, and thus, it is difficult to pull out the gun immediately once an emergency state occurs. If the user uses the whole palm to press the press portion, the timing for pulling out the gun is delayed.

SUMMARY OF THE INVENTION

Accordingly, the primary object of the present invention is to provide a gun cover with a securing assembly, wherein a pistol can be firmly secured. A press portion is installed between an inner lateral plate and a waist plate and it projects from an inner upper side of an outer frame to be near the user's body. The press portion is near the body so that it can adhere upon the body to reduce the possibility of rending the gun. Thereby the installation of the pistol matches the ergonomics about the action of pulling-out the pistol by the user. In pulling the pistol out of the cover, the thumb of the user can press the press portion and then the other four fingers can pull the pistol successfully and easily. The present invention is especially suited from the emergency states.

To achieve above objects, the present invention provides a gun cover with a securing assembly which comprises a waist plate at an inner side thereof; and an enclosure for defining a gun groove; the enclosure having an inner lateral plate and an outer lateral plate; the inner lateral plate having a through hole for receiving an elastic tenon which protrudes from an interior of the gun groove; the elastic tenon having a press portion; the press portion being installed between the inner lateral plate and an inner side of the waist plate and projects out of an upper side of the outer frame.

The gun cover further comprises an inner liner having a U shape cross section; the inner liner having an outer lateral sheet and an inner lateral sheet; an inner strip being installed at one side of the outer lateral sheet; the inner lateral sheet having a through hole; an outer frame having a U shape cross section; the outer frame having an inner lateral sheet; one side of the inner lateral sheet having an outer strip; and a stop plate vertically extending from the outer lateral plate; The inner liner has an assembled hole. The inner liner; the outer frame; the inner lateral plate; and the outer lateral plate have assembled holes; and a plurality of assembly units passes through the assembled holes for assembly these components. The outer frame has a view hole for viewing the inner liner so as to present a beautiful outlook and save material.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
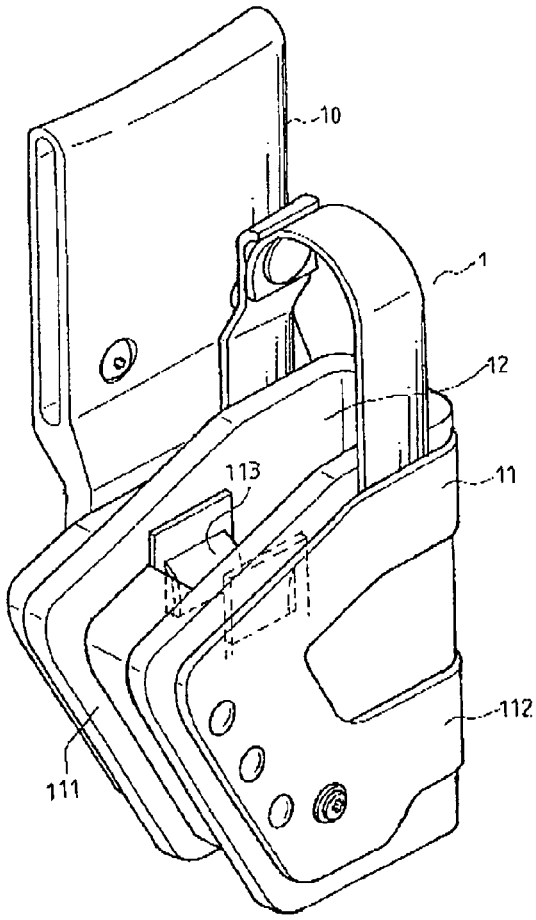
Fig. 1 (PRIOR ART)
FIG. 1 is a perspective view of prior art.
Figure 2:
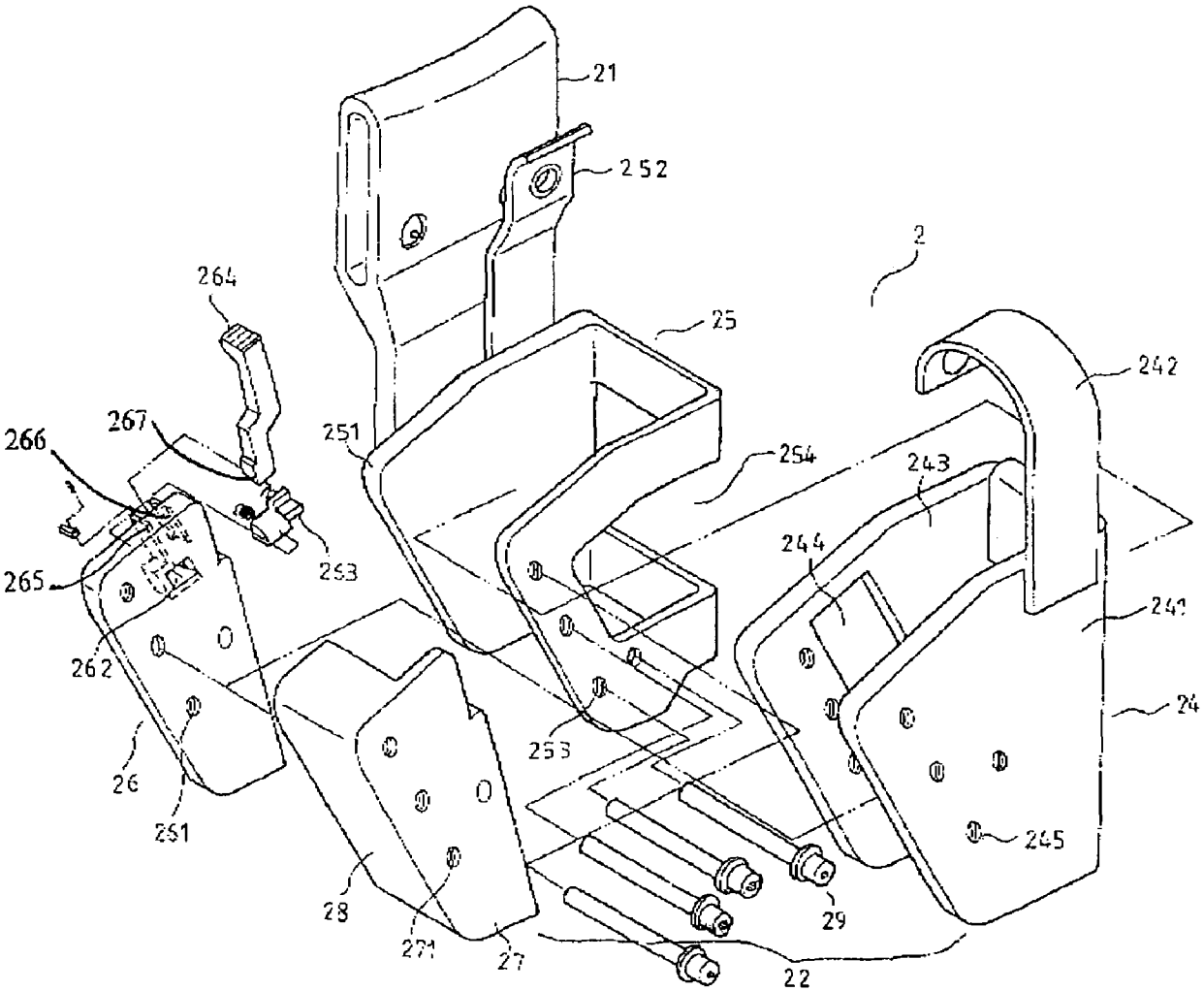
FIG. 2 is an exploded perspective view of the present invention.
Figure 3:
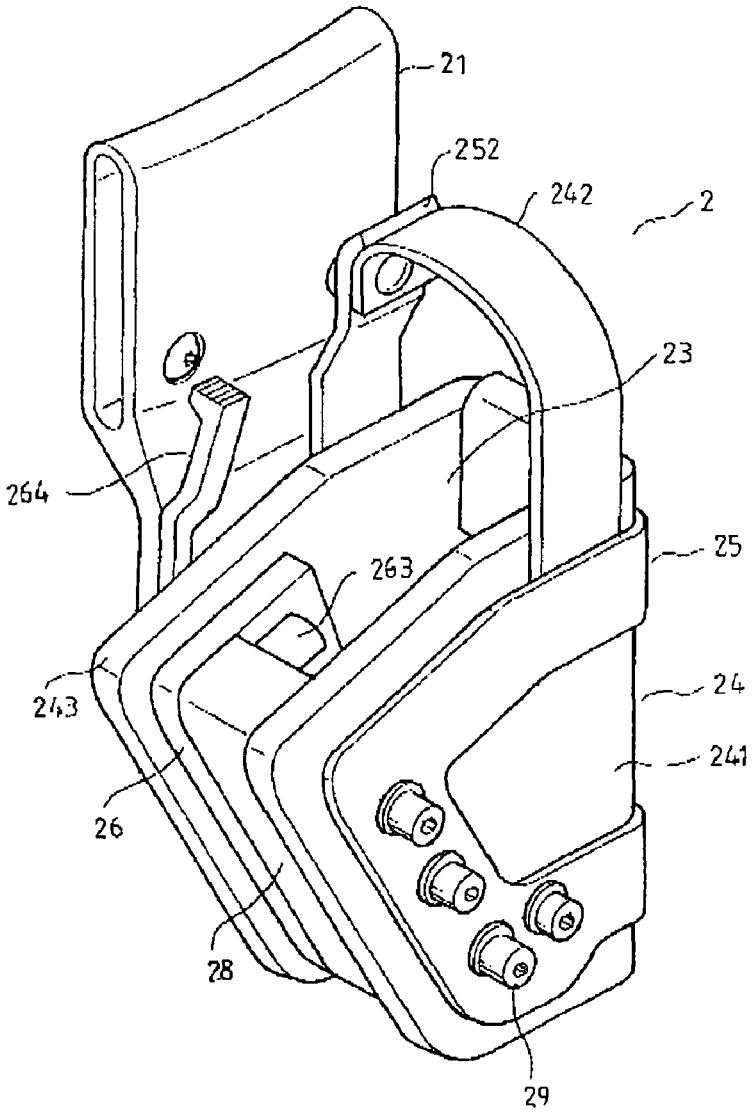
FIG. 3 is an assembled perspective view of the present invention.
Figure 4:
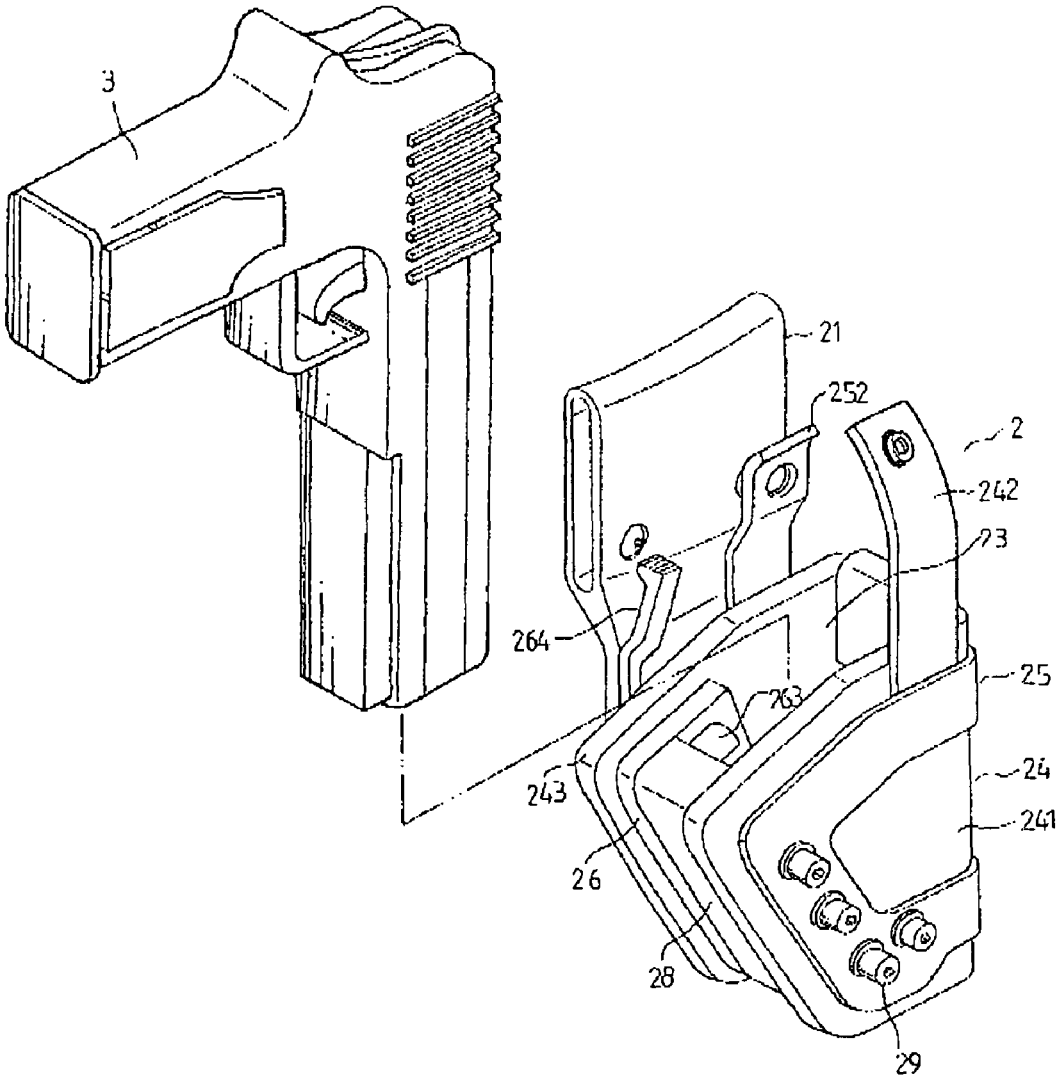
FIG. 4 is a perspective view of the present invention.

Referring to FIGS. 2 and 3, a cover assembly of a gun cover of the present invention is illustrated. In the present invention, the gun cover 2 has a waist plate 21 at an inner side thereof. The gun cover 2 has an enclosure 22 which defines a gun groove 23, as shown in FIG. 4 for receiving a gun 3. The enclosure 22 has the following elements.

An inner liner 24 has a U shape cross section. The inner liner 24 has an outer lateral sheet 241 and an inner lateral sheet 243. An inner strip 242 is installed at one upper side of the outer lateral sheet 241. The inner lateral sheet 243 has a through hole 244.

An outer frame 25 has a U shape cross section. The outer frame 25 has an inner lateral sheet 251. One side of the inner lateral sheet 251 has an outer strip 252. The outer frame 25 has a view hole 254 for viewing the inner liner 24 so as to present a beautiful outlook and save saving material.

A lateral plate set includes an inner lateral plate 26 and an outer lateral plate 27. A stop plate 28 vertically extends from the outer lateral plate 27. The inner lateral plate 26 has a through hole 262 and two protruding plates 265, 266 on an outer side thereof for receiving elastic tenon 263 which protrudes from an interior of the gun groove 23. The elastic tenon 263 has a press portion 264. The press portion 264 is installed between the inner lateral plate 26 and an inner side of the waist plate 21 and projects out of an upper side of the outer frame 25. The inner liner 24 has a plurality of assembled holes 245. The outer frame 25 has a plurality of assembled holes 253. The inner lateral plate 26 has a plurality of assembled holes 261 and the outer lateral plate 27 has a plurality of assembled holes 271. A plurality of assembly units 29 pass through the assembled holes 245, 253, 261 and 271 for assembling these components.

Figure 5:
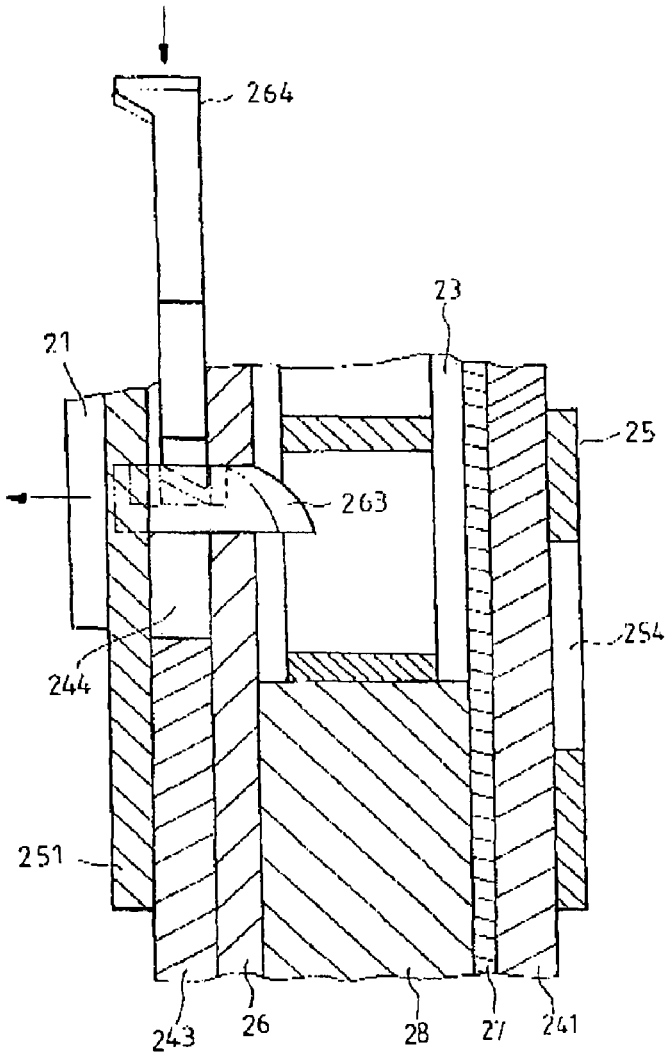
FIG. 5 is a schematic view showing the operation of the present invention.

With reference to FIG. 5, the elastic tenon 263 can steadily secure a gun 3 in the gun cover 2 of the present invention.

Figure 6:
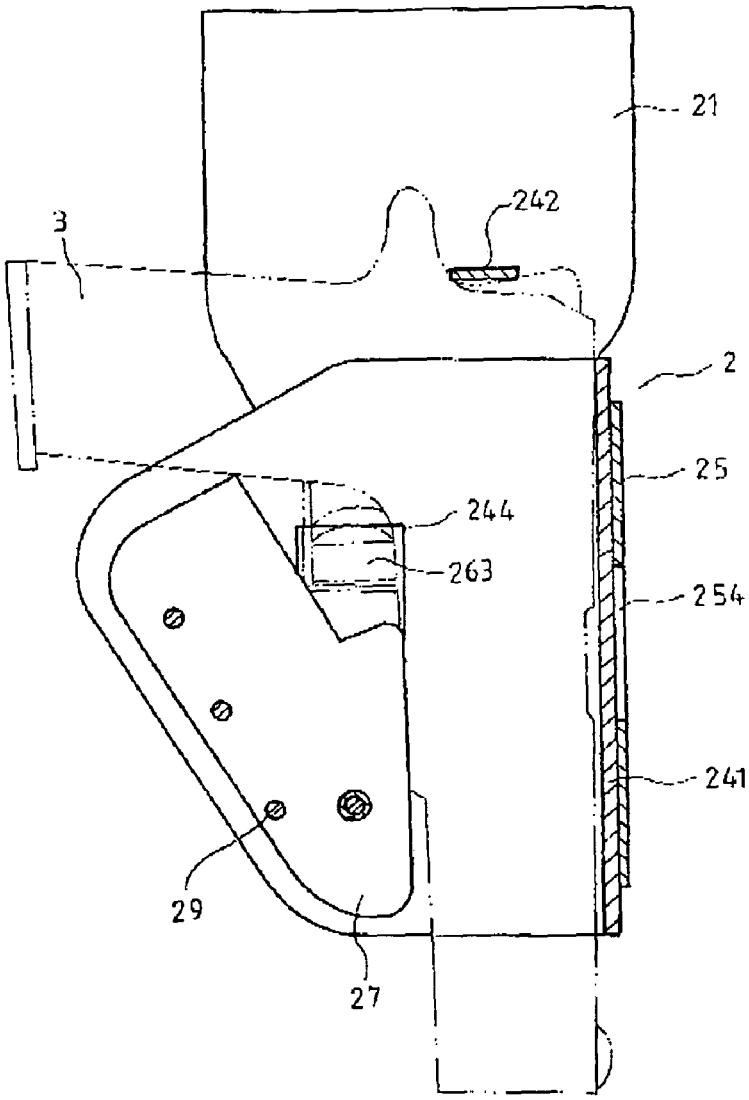
FIG. 6 is a schematic cross sectional view about the installation of a gun received in the gun cover of the present invention.

With reference to FIG. 6, in use, when it is desired to take out the gun, the press portion 264 is pressed such that a sloped surface 267 of the press portion engages an upper surface of the elastic tenon to release the elastic tenon 263. Thus the elastic tenon 263 is pressed and thus released. The press portion 264 is near the body so that it can adhere upon the body to reduce the possibility of losing the gun.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A gun cover with a securing assembly comprising:

an inner liner (24) having a U shape cross section which defines a gun groove (23); the inner liner (24) having an outer lateral sheet (241) and an inner lateral sheet (243); an inner strip (242) being installed at one upper edge of the outer lateral sheet (241); the inner lateral sheet (243) having a through hole (244);

an outer frame (25) having a U shape cross section; the outer frame (25) having an inner lateral sheet (251); one side of the inner lateral sheet (251) having an outer strip (252); the outer frame (25) having a view hole (254);

a lateral plate set including an inner lateral plate (26) and an outer lateral plate (27); a stop plate (28) vertically extending from the outer lateral plate;

the inner lateral plate (26) having a through hole (262); and an outer side of the inner lateral plate (26) is formed with a guide unit formed of two protruding plates (265) and (266) which are received within the through hole (244);

an elastic tenon (263) protruding through the through hole (262) and into an interior of the gun groove (23);

a press portion (264); the press portion (264) being installed within the guide unit and between the inner lateral plate (26) and an inner side of a waist plate (21) and projecting out of an upper side of the outer frame (25); and a lower side of the press portion (264) is formed with a sloped surface (267) for engaging an upper surface of the elastic tenon when the gun cover is assembled; and the inner liner (24) having a plurality of assembled holes (245); the outer frame (25) having a plurality of assembled holes (253); the inner lateral plate (26) having a plurality of assembled holes (261) and the outer lateral plate (27) having a plurality of assembled holes (271); a plurality of assembly units (29) passing through the assembled holes (245), (253), (261) and (271) for assembling these components.

* * * * *